US008336137B2

(12) United States Patent
Aprile et al.

(10) Patent No.: US 8,336,137 B2
(45) Date of Patent: Dec. 25, 2012

(54) SEMI-FITTED BEDSHEET AND METHOD OF MANUFACTURING SAME

(75) Inventors: Rita Aprile, Millstone, NJ (US); Caterina Angelicola, Howell, NJ (US)

(73) Assignee: Effortless Bedding LLC, Freehold, NJ (US)

( * ) Notice: Subject to any disclaimer, the term of this patent is extended or adjusted under 35 U.S.C. 154(b) by 330 days.

(21) Appl. No.: 11/849,792

(22) Filed: Sep. 4, 2007

(65) Prior Publication Data

US 2009/0056018 A1 Mar. 5, 2009

(51) Int. Cl.
*A47G 9/04* (2006.01)

(52) U.S. Cl. ..... 5/497; 5/495; 5/498; 5/499

(58) Field of Classification Search ..... 5/497, 482, 5/485, 498, 483, 486, 493, 499, 494–496
See application file for complete search history.

(56) References Cited

U.S. PATENT DOCUMENTS

| | | | | | |
|---|---|---|---|---|---|
| 2,757,389 | A | | 8/1956 | King | |
| 3,868,735 | A | | 3/1975 | Ross | |
| 3,962,739 | A | * | 6/1976 | Crockett | 5/497 |
| 4,021,869 | A | | 5/1977 | Root | |
| 4,245,365 | A | | 1/1981 | Large | |
| 5,027,460 | A | | 7/1991 | Honig | |
| 5,165,128 | A | * | 11/1992 | Honig | 5/497 |
| 5,189,744 | A | * | 3/1993 | Roberts | 5/497 |
| 5,465,440 | A | * | 11/1995 | Heptner | 5/497 |
| 6,041,456 | A | | 3/2000 | Pharr | |
| 6,061,851 | A | * | 5/2000 | Crowell | 5/497 |
| 2004/0200000 | A1 | * | 10/2004 | Harbin et al. | 5/497 |
| 2005/0071924 | A1 | * | 4/2005 | Ratigan | 5/497 |
| 2005/0193490 | A1 | * | 9/2005 | Macdonald | 5/500 |
| 2007/0174963 | A1 | * | 8/2007 | Howard | 5/497 |

FOREIGN PATENT DOCUMENTS

FR 2 859 087 3/2005

OTHER PUBLICATIONS

PCT/ISA/220, "Notification of Transmittal of the International Search Report . . . ", for PCT/US2008/067586, Mailed Aug. 14, 2008, (3 Pgs).
PCT/ISA/237, "Written Opinion of the International Searching Authority", for PCT/US2008/067586, Mailed Aug. 14, 2008, (4 Pgs).
PCT/ISA/210, "International Search Report", for PCT/US2008/067586, Mailed Aug. 14, 2008, (3 Pgs).

* cited by examiner

*Primary Examiner* — William Kelleher
(74) *Attorney, Agent, or Firm* — Jon Fallon, Esq.

(57) ABSTRACT

Embodiments of the present invention relate to a bedsheet comprising a non-fitted portion and a fitted portion for securing the bedsheet onto one end of a mattress, and a method for manufacturing the same. In one embodiment, a semi-fitted bedsheet comprises a seamless fitted portion, a non-fitted portion, and a securing means incorporated along an edge of the fitted portion. In another embodiment, a semi-fitted bedsheet further comprises a position indicator for identifying a proper positioning of the bedsheet on a mattress.

18 Claims, 4 Drawing Sheets

SEMI-FITTED BEDSHEET AND METHOD OF MANUFACTURING SAME

BACKGROUND OF THE INVENTION

1. Field of the Invention

Embodiments of the present invention generally relate to a semi-fitted bedsheet and method thereof. More specifically, embodiments of the present invention relate to a bedsheet comprising a non-fitted portion and a fitted portion for securing the bedsheet onto one end of a mattress, and a method for manufacturing the same.

2. Description of the Related Art

Traditional bedsheets consist of a fitted bottom sheet and a flat top sheet. Fitted bottom sheets are provided with an elastic edge surrounding the entire sheet, and are used to maintain the position of the sheet on the bed. By positioning the elastic edge around a mattress, fitted bottom sheets encompass and protect the surface of the mattress.

Flat top sheets are substantially flat blanks of woven fabric that may be draped over a mattress. Often, the bottom edge and both side edges of the flat top sheet are tucked underneath the mattress. During the course of sleeping, however, a restless sleeper may toss and turn and, as a result, disengage at least a portion of the flat top sheet from underneath the mattress.

Another problem with many flat top sheets is a lack of user-friendliness for physically challenged consumers. Physically challenged persons may have difficulty lifting a mattress to tuck a flat top sheet underneath. Even without lifting the mattress, the ability to forcefully tuck a flat top sheet underneath the mattress requires a certain strength and skill set not all persons possess. Similarly, persons with certain disabilities, such as blindness, may have a very difficult time determining the positioning of the flat top sheet as it is being tucked underneath the mattress.

To overcome some of these problems, attempts have been made to create a partially-fitted top sheet, i.e., a sheet having a fitted end for at least partially securing to a mattress. However, none of the known partially-fitted top sheets address each of the aforementioned failures of traditional flat top sheets. Moreover, one common problem with many of the known partially-fitted top sheets is their complexity. Many have complex structures requiring a great deal of attention and production/manufacturing time. These partially-fitted top sheets generally require a great deal of tailoring and seamstress work in order to create and hold all of the necessary pockets and folds.

Thus, there is a need for an improved semi-fitted bedsheet.

SUMMARY OF THE INVENTION

Embodiments of the present invention generally relate to a bedsheet comprising a non-fitted portion and a fitted portion for securing the bedsheet onto one end of a mattress. In one embodiment of the present invention, a semi-fitted bedsheet comprises a seamless fitted portion, a non-fitted portion, and a securing means incorporated along an edge of the fitted portion. In another embodiment, a semi-fitted bedsheet further comprises a position indicator for identifying a proper positioning of the bedsheet on a mattress.

In another embodiment of the present invention, a method for making a semi-fitted bedsheet comprises providing a blank of material, making a single cut along a first end of the blank of material, creating at least a position indicator in the blank of material, and incorporating a securing means along an edge of the first end of the blank of material.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
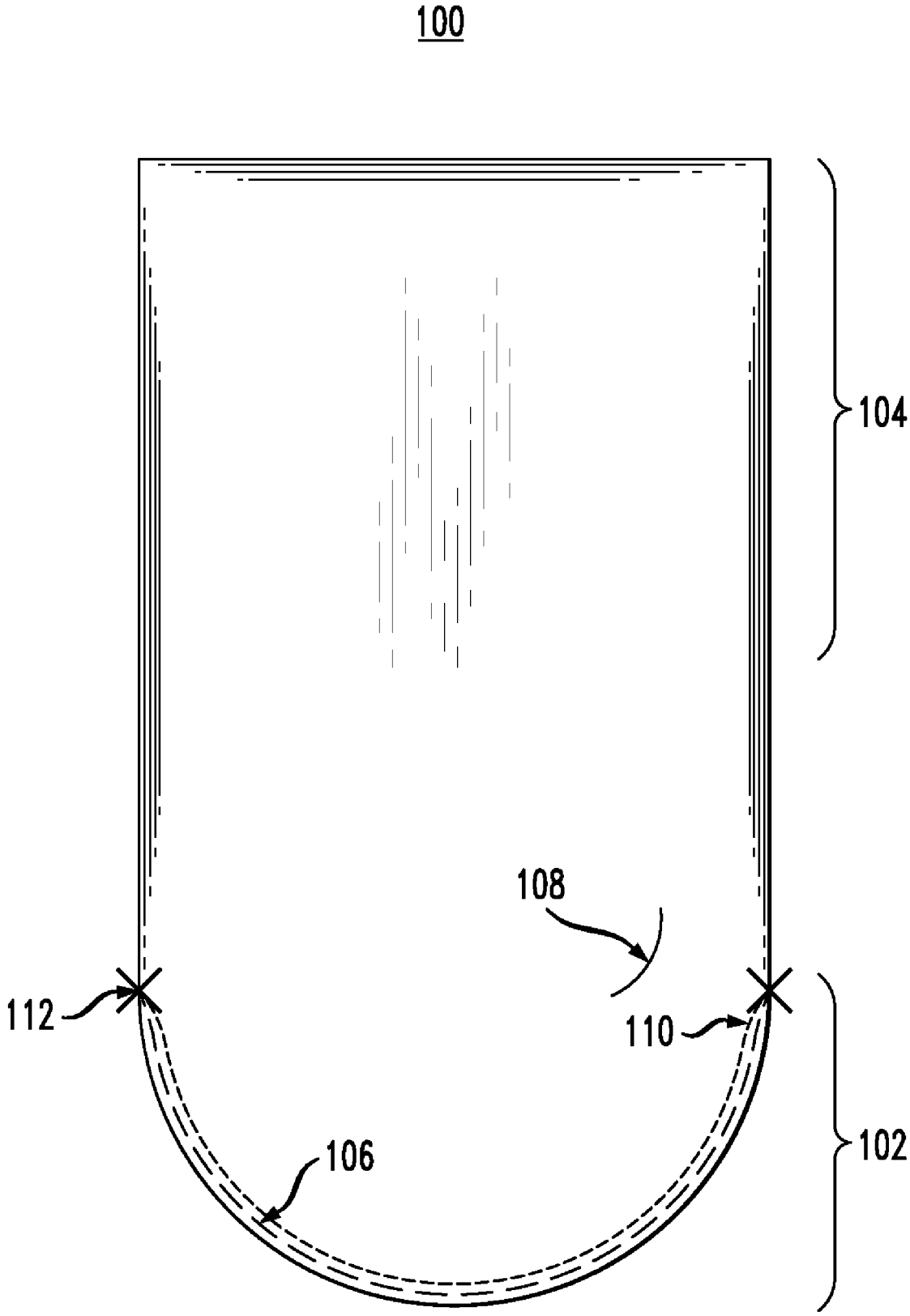
FIG. 1 depicts a top view of a semi-fitted bedsheet in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention generally relate to a semi-fitted bedsheet and method thereof. More specifically, embodiments of the present invention relate to a bedsheet comprising a non-fitted portion and a fitted portion for securing the sheet onto one end of a bed.

FIG. 1 depicts a top view of a semi-fitted bedsheet in accordance with one embodiment of the present invention. Embodiments of the present invention comprise a semi-fitted bedsheet 100. Generally, the semi-fitted bedsheet comprises a fitted portion 102 and a non-fitted portion 104. The non-fitted portion 104 of the bedsheet 100 is analogous to a conventional flat top sheet, being substantially unobstructed or non-aesthetically modified. Generally, in accordance with embodiments of the present invention, the bedsheet 100 comprises at least one of cotton, polyester, or flannel material.

The fitted portion 102 of embodiments of the present invention is seamless, such that no seams or stitching, for purposes of fitting to the contour of a mattress (e.g., to conform to the right angles of a corner of a mattress), are provided. Moreover, embodiments of the present invention are generally designed independent of the thickness of the mattress such that a bed in accordance with embodiments of the present invention may accommodate a standard mattress as well as an extra deep mattress.

The fitted portion 102 generally comprises a securing means 106 to secure the bedsheet 100 to at least one end of a mattress (not shown). The securing means 106 is generally positioned along an edge of the fitted portion 102 of the bedsheet 100. In one embodiment, the securing means 106 comprises a strip of elastic material. In another embodiment, the securing means 106 comprises at least one of natural rubber fibers, synthetic rubber fibers, spandex fibers, or the like.

In many embodiments, a channel 110 is provided along an edge of the fitted portion 102 of the bedsheet 100. In one embodiment, the channel 110 is formed from a hem, as a section of material is folded over itself and stitched shut to create a channel 110. It is understood by embodiments of the present invention, the formation of a channel 110 in such a manner does not interfere with the seamlessness of the fitted portion 102, whereas the channel 110 is not for purposes of fitting to the contour of a mattress.

In certain embodiments, the securing means 106 may be housed within the channel 110, and secured via an anchoring stitch 112 at each end of the channel 110. In another embodiment, the securing means 106 may be interwoven into the material of bedsheet 100 itself. For example, where spandex fibers are provided as a securing means 106, the spandex fibers may be woven into the woven fabric of the bedsheet 100, along an edge of the fitted portion 102. In an alternative embodiment, the securing means 106 may be affixed to an edge of the fitted portion 102. For example, where a strip of natural or synthetic rubber fibers or fabric are provided as a securing means 106, the strip of natural or synthetic rubber fibers or fabric are affixed, via an adhesive, stitching, or the like, to an outermost edge of the fitted portion 102 of the bedsheet 100.

Embodiments of the present invention optionally comprise a position indicator 108. In accordance with embodiments of the present invention, the position indicator 108 may indicate the position visually, palpably, or audibly to the user. In one embodiment of the present invention, the position indicator 108 comprises a piece of fabric substantially different from the material composition of the bedsheet 100. For example, in one embodiment, the bedsheet 100 may comprise a cotton blend material and the position indicator 108 comprises a felt or plush material. In another embodiment, the position indicator 108 comprises a dart. For the purpose of this patent application, the term "dart" is intended to mean a stitch which directs an article of fabric to conform to the contours of the body to which it is fit.

Figure 2:
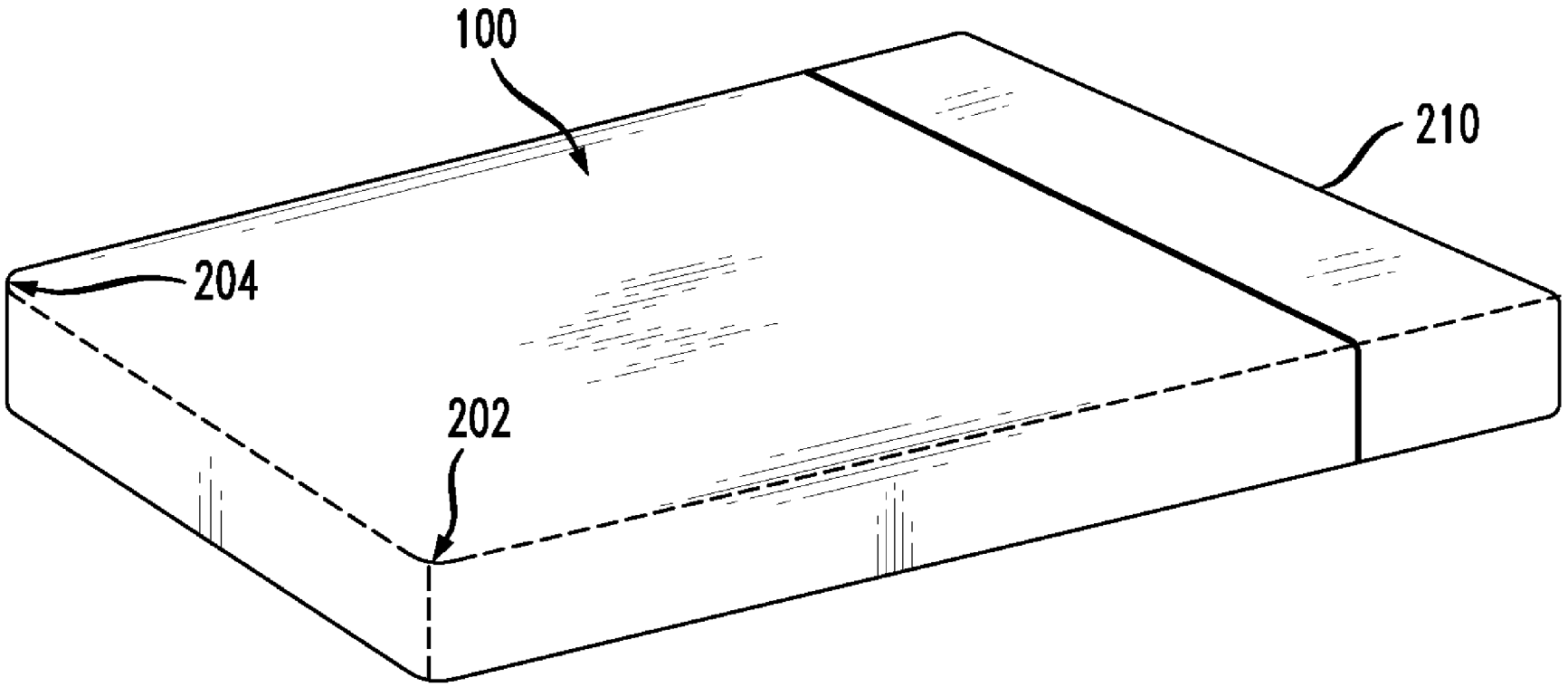
FIG. 2 depicts a perspective view of a semi-fitted bedsheet in operation in accordance with one embodiment of the present invention.

FIG. 2 depicts a perspective view of a semi-fitted bedsheet in operation in accordance with one embodiment of the present invention. In one embodiment, a dart 202 is used as a position indicator to indicate to the user the relative position of the bedsheet 100 on a mattress 210. As the semi-fitted bedsheet 100 is positioned on the mattress 210, the position of the dart 202 coincides with the corresponding corner of the mattress 210. In accordance with another embodiment of the present invention, the semi-fitted bedsheet comprises a second position indicator 204.

Other embodiments provide a position indicator 108 comprising substantially the same material as the bedsheet 100, and having a substantially different color or pattern. In yet another embodiment, the position indicator 108 comprises a sensor. In such an embodiment, the sensor may emit a sound or other signal to notify an individual, particularly an individual with a visual impairment, of the location of the position indicator 108.

Figure 3C:
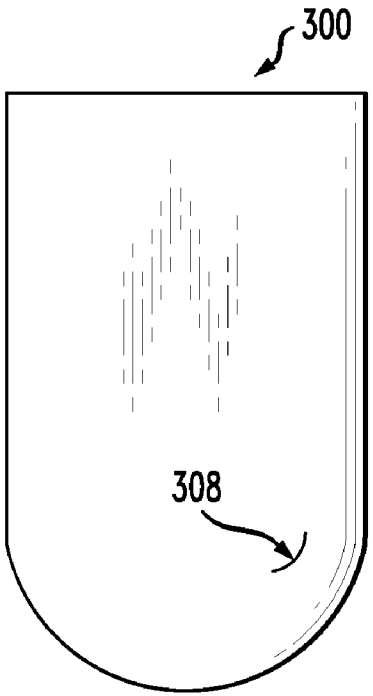
FIGS. 3A-3E depict a method of manufacturing a semi-fitted bedsheet in accordance with one embodiment of the present invention.
Figure 3B:
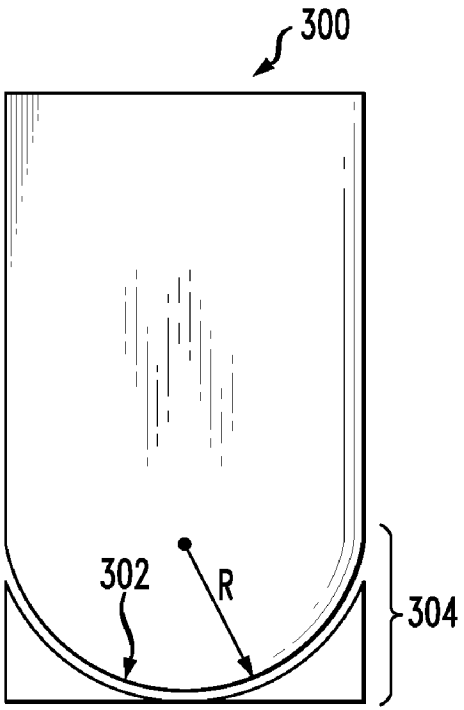
Figure 3A:
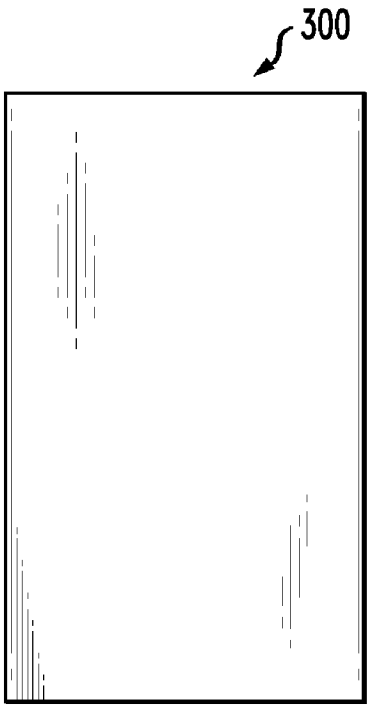

Referring now to FIGS. 3A-3B, one method for manufacturing the semi-fitted bedsheet in accordance with embodiments of the present invention is disclosed in a step-by-step process. As generally understood by those of ordinary skill in the art, this method may be performed in any logical order, and should not be limited by the order of the steps discussed herein.

As shown in FIG. 3A, a method comprises providing a rectangular blank of material 300. As shown in FIG. 3B, a single cut 302 is made along a first end 304 of the rectangular blank of material 300. In accordance with embodiments of the present invention, this cut 302 is a single, continuous cut having either a constant radius of curvature or a variable radius of curvature R.

Referring now to FIG. 3C, a position indicator 308 may be created in the blank of material. In one embodiment of the present invention, the creation of a position indicator 308 comprises stitching a plurality of fibers or a continuous fiber along an arc or angle into the blank of material 300. The location of the position indicator 308 may be determined by the size of the blank of material 300 and/or the size or intended size of a mattress on which a bedsheet in accordance with embodiments of the present invention should be utilized.

Figure 3E:
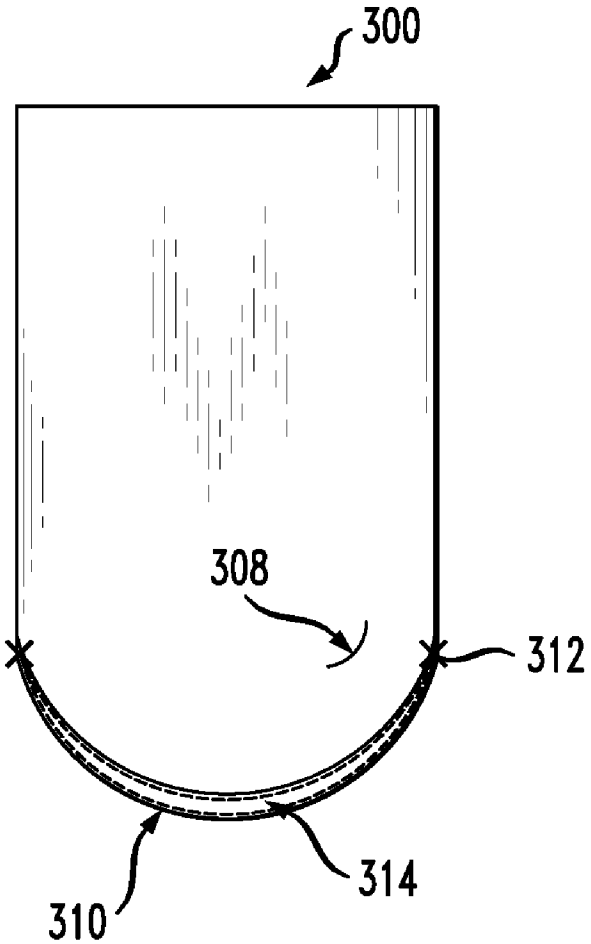
Figure 3D:
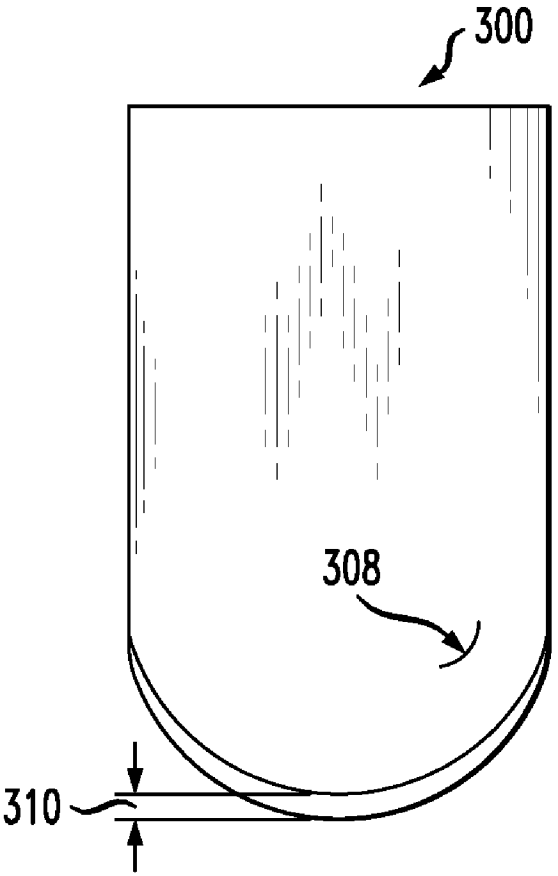

In FIG. 3D, a channel 310 may be formed along an edge of the first end 304 of the blank of material 300. In one embodiment, the channel 310 may be formed by creating a hem along a fold in the blank of material along the edge of the first end 304. In accordance with embodiments of the present invention, as shown in FIG. 3E, a securing means 314 is incorporated into the channel 310 to provide expandability and resilience to the edge of the first end 304 of the blank of material 300. In one embodiment, the securing means 314 is anchored to a first end and second end of the channel 310 via anchoring stitches 312. Optionally, a plurality of anchoring stitches may be provided along the securing means 314, and through the channel 310, to provide stability to the first end, and in certain embodiments, may prevent the securing means 314 from snapping or breaking.

While the foregoing is directed to embodiments of the present invention, other and further embodiments of the invention may be devised without departing from the basic scope thereof.

What is claimed is:

1. A semi-fitted bedsheet comprising:

a fitted portion, defined by a distal end and a first and second outermost side edge of the bedsheet, the first and second outermost side edges being inclusive of the widest edges of the entire bedsheet, comprising:

a securing means incorporated along a continuously convex outer edge of the bedsheet, along a perimeter of the fitted portion, and a remainder of the fitted portion being free of seams, free of cuts, and free of stitching for purposes of fitting to the contour of a mattress; and a non-fitted portion, defined by an end of the bedsheet opposing the distal end.

2. The semi-fitted bedsheet of claim 1, further comprising a position indicator for identifying a proper positioning of the bedsheet on a mattress.

3. The semi-fitted bedsheet of claim 2, wherein the position indicator comprises a dart.

4. The semi-fitted bedsheet of claim 2, wherein the position indicator comprises at least one of a sensor or a piece of fabric material substantially different from the material of the bedsheet.

5. The semi-fitted bedsheet of claim 2, further comprising at least a plurality of position indicators.

6. The semi-fitted bedsheet of claim 1, wherein the bedsheet comprises at least one of cotton, polyester, or flannel.

7. The semi-fitted bedsheet of claim 1, wherein the securing means comprises an elastic material.

8. The semi-fitted bedsheet of claim 7, wherein the strip of elastic material comprises a plurality of at least one of natural rubber, synthetic rubber, or spandex fibers.

9. The semi-fitted bedsheet of claim 1, wherein the securing means is housed in a channel along the edge of the fitted portion.

10. The semi-fitted bedsheet of claim 9, wherein the securing means is anchored to at least a first end and a second end of the channel.

11. The semi-fitted bedsheet of claim 10, wherein the securing means is anchored using a plurality of threads stitched into the securing means and through the fitted portion.

12. The semi-fitted bedsheet of claim 9, wherein the channel is formed from a hem along the edge of the fitted portion.

13. A semi-fitted bedsheet comprising:

a fitted portion, defined by a distal end and a first and second outermost side edge of the bedsheet, the first and second outermost side edges being inclusive of the widest edges of the entire bedsheet, having an elastic material incorporated along in a channel along a continuously convex outer edge of the bedsheet, along a perimeter of the fitted portion, and a remainder of the fitted portion is free of seams, free of cuts, and free of stitching for purposes of fitting to the contour of a mattress;

a non-fitted portion, defined by an end of the bedsheet opposing the distal end; and a dart for identifying a proper positioning of the bedsheet on a mattress.

14. The semi-fitted bedsheet of claim 13, further comprising at least a plurality of darts.

15. The semi-fitted bedsheet of claim 13, wherein the bedsheet comprises at least one of cotton, polyester, or flannel.

16. The semi-fitted bedsheet of claim 13, wherein elastic material is anchored using a plurality of threads stitched into a first and second end of the elastic material and through the fitted portion.

17. A semi-fitted bedsheet comprising:

a fitted portion, defined by a distal end and a first and second outermost side edge of the bedsheet, the first and second outermost side edges being inclusive of the widest edges of the entire bedsheet, comprising:

an elastic material incorporated along in a hemmed channel along a continuously convex outer edge of the bedsheet, along a perimeter of the fitted portion and anchored using a plurality of threads stitched into a first and second end of the elastic material and through the fitted portion, and a remainder of the fitted portion is free of seams, free of cuts, and free of stitching for purposes of fitting to the contour of a mattress; and a non-fitted portion, defined by an end of the bedsheet opposing the distal end; and a plurality of darts for aligning the semi-fitted bedsheet with corners on a mattress.

18. The semi-fitted bedsheet of claim 17, wherein the bedsheet comprises at least one of cotton, polyester, flannel or combinations thereof.

* * * * *